United States Patent [19]

Avery et al.

[11] 4,413,674

[45] Nov. 8, 1983

[54] TRANSFORMER COOLING STRUCTURE

[75] Inventors: Randall N. Avery; Charles A. Clayton; Levon R. Floyd; Douglas B. Mackintosh, all of South Boston; Willie A. Powell, Alton; Michael W. Atkins, Danville, all of Va.

[73] Assignee: Westinghouse Electric Corp., Pittsburgh, Pa.

[21] Appl. No.: 472,327

[22] Filed: Mar. 4, 1983

Related U.S. Application Data

[63] Continuation of Ser. No. 211,147, Nov. 28, 1980, abandoned.

[51] Int. Cl.[3] ..... F28D 15/00; H01F 27/14

[52] U.S. Cl. ..... 165/104.33; 165/130; 336/58

[58] Field of Search ..... 165/104.19, 104.33, 165/128, 130; 336/58

[56] References Cited

U.S. PATENT DOCUMENTS

| | | | |
|---|---|---|---|
| 1,492,163 | 4/1924 | Eaton | 165/104.33 |
| 1,574,960 | 3/1926 | Dann et al. | 336/58 X |
| 1,838,722 | 12/1931 | Watson | 165/130 |
| 1,847,176 | 3/1932 | Frame | 165/130 |

FOREIGN PATENT DOCUMENTS

| | | | |
|---|---|---|---|
| 2512404 | 10/1976 | Fed. Rep. of Germany | 336/58 |
| 2749508 | 5/1979 | Fed. Rep. of Germany | 336/58 |
| 55-63812 | 5/1980 | Japan | 336/58 |
| 55-71010 | 5/1980 | Japan | 336/58 |
| 55-98808 | 7/1980 | Japan | 336/58 |
| 55-118611 | 9/1980 | Japan | 336/58 |

*Primary Examiner*—Albert W. Davis, Jr.
*Attorney, Agent, or Firm*—L. P. Johns

[57] ABSTRACT

A transformer cooling structure characterized by a plurality of coolant fluid cooling panels extending outwardly from the transformer tank wall, and the panels being comprised of a pair of sheet-like sides formed to a corrugated configuration through which the fluid flows in heat exchange with ambient air.

11 Claims, 7 Drawing Figures

FIG. 1
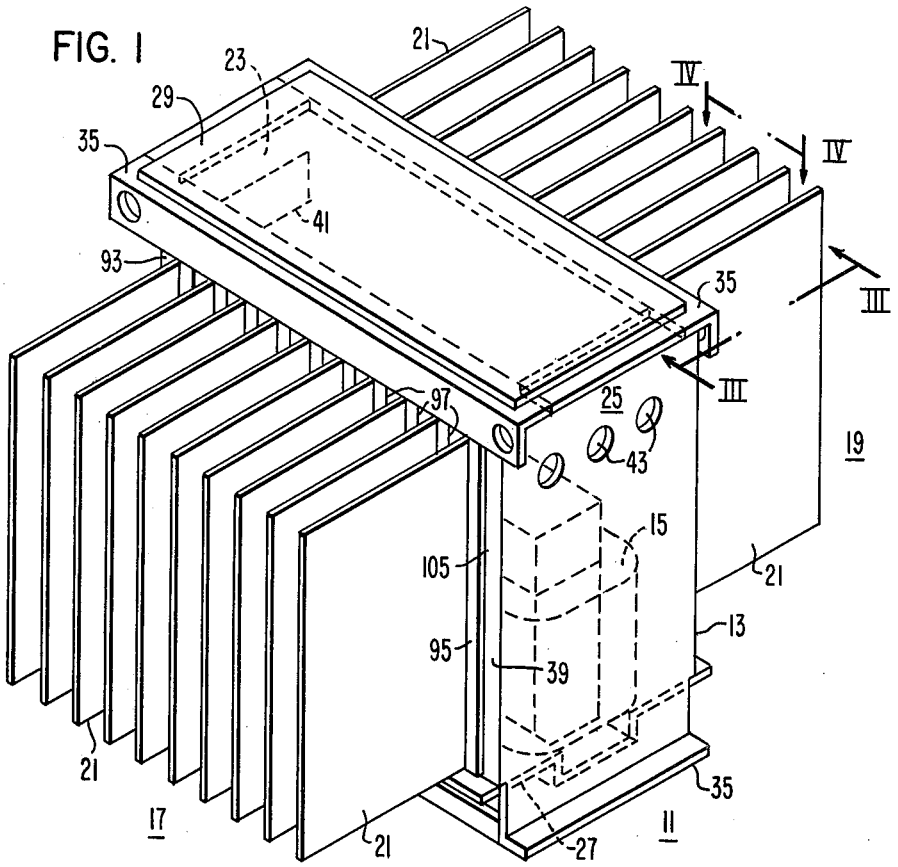
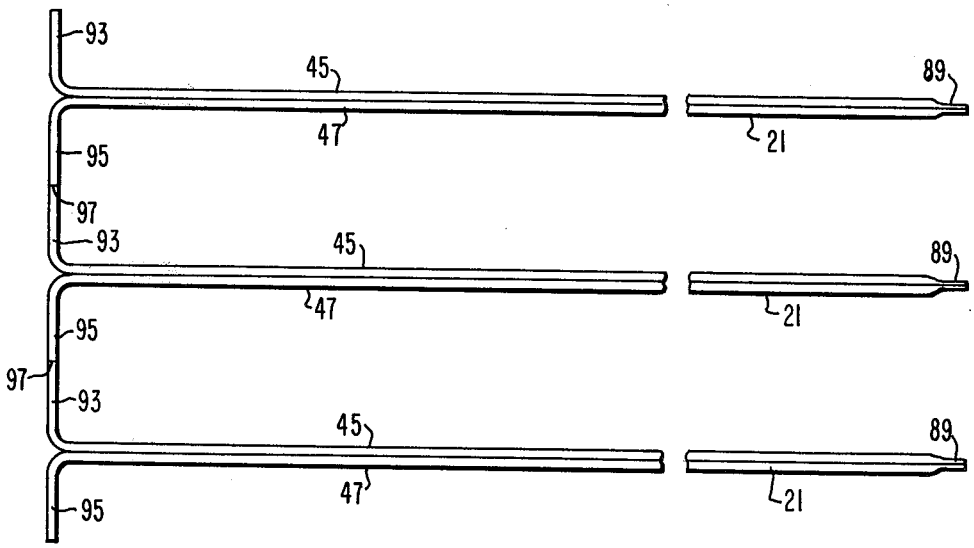
FIG. 4

TRANSFORMER COOLING STRUCTURE

This is a continuation of application Ser. No. 211,147, filed Nov. 28, 1980 now abandoned.

BACKGROUND OF THE INVENTION

1. Field of the Invention:

This invention relates to a heat exchanger unit for cooling of cooling fluid of an electrical transformer, or other device, employing a circulating fluid coolant.

2. Description of the Prior Art:

Tanks containing a transformer submerged in a cooling fluid may be provided with a radiator, or heat exchanger, for transferring heat from cooling fluid to ambient air. The radiators or heat exchangers vary in construction, depending upon several factors, such as the rating of the transformer. Prior art heat exchangers differ in their structural form, but are generally complicated for which reason they have been an unnecessarily costly addition to the transformer tank per se.

Associated with the foregoing has been a problem of reducing the volume of the cooling fluid in the transformer in order to reduce the unit volume and therefore cost of the cooling fluid.

SUMMARY OF THE INVENTION

In accordance with this invention it has been found that the foregoing problems may be overcome by providing a tank for a transformer submerged in a cooling fluid, the tank comprising a preferably rectangular cross section having opposite side walls, opposite edge walls, and top and bottom end walls, each opposite side wall including a plurality of cooling panels extending outwardly from the plane of the wall which panels comprise a pair of oppositely disposed sides having facing peripheral edge portions and end portions that are secured together in a fluid-tight seal, the sides being sheet metal members formed to include aligned corrugated surfaces forming spaced fluid-conducting headers and fluid conduits therebetween, each side comprising an out-turned flange along the edges adjacent the tank, the edges of the flanges of adjacent panels being secured together in a fluid-tight manner to form the corresponding side wall of the tank, said walls having inlet and outlet means for said fluid and communicating with the spaced headers of corresponding panels.

The advantage of the tank design of this invention is that it combines several features simplifying the design and construction of a tank including the combination of prior separate functions of cooling and bracing, the use of welds to reduce metal gauge, and integral stamping of conducting headers and fluid conduits in the panels.

BRIEF DESCRIPTION OF THE DRAWINGS

FIG. 1 is a schematic view of a transformer tank with heat exchanger panels extending from opposite side walls thereof in accordance with this invention;

FIG. 4 is an enlarged plan view taken on the line IV—IV of FIG. 1 of a plurality of cooling panels;

DESCRIPTION OF THE PREFERRED EMBODIMENT

Figure 2:
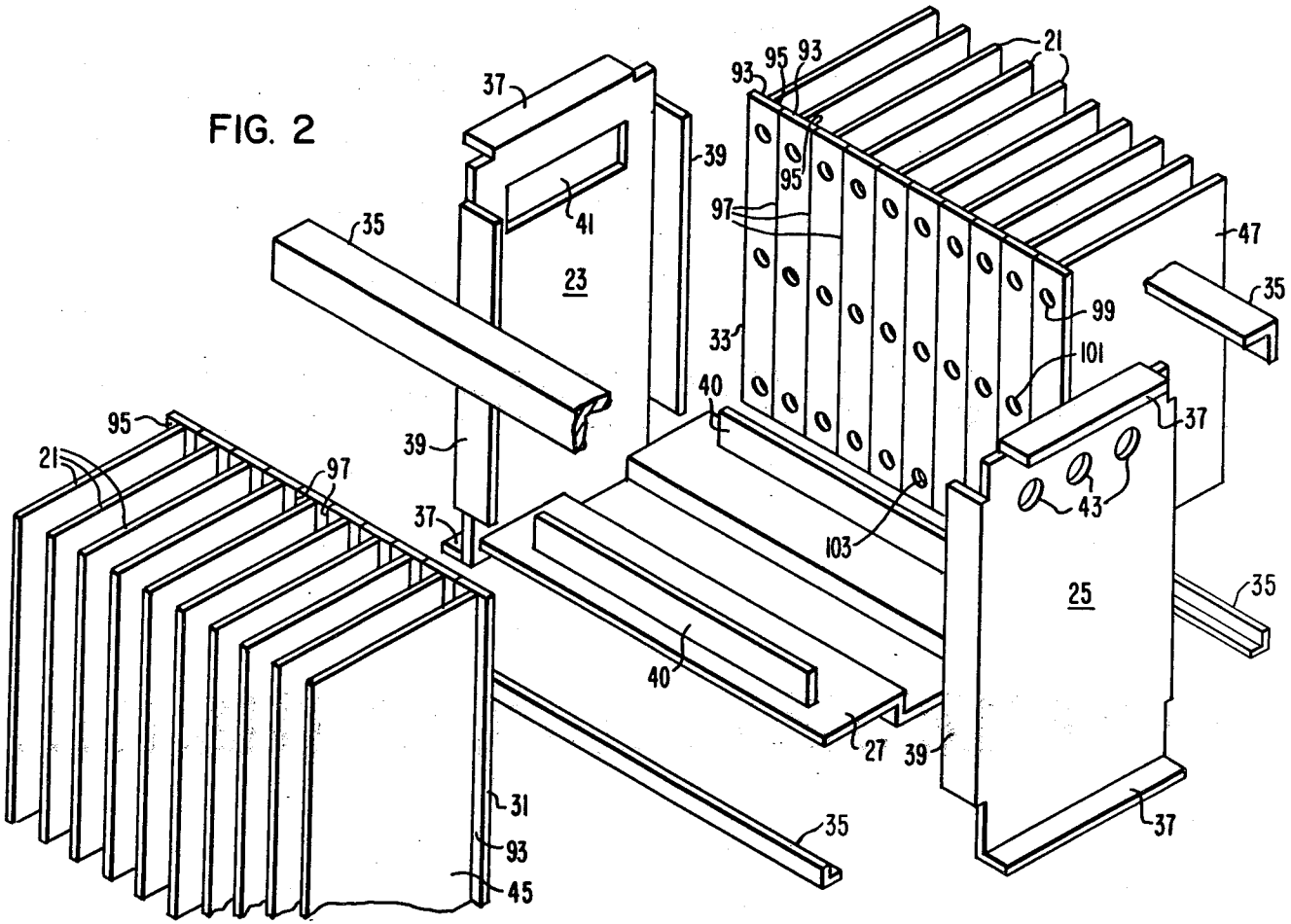
FIG. 2 is an exploded view of the device of FIG. 1.

In FIG. 1 a transformer structure is generally indicated at 11 and it comprises a tank 13 which contains a transformer unit 15, and which includes two banks 17, 19 of heat exchanger panels 21 extending from opposite sides of the tank.

Although the tank 13 is described as containing a transformer unit 15, it is understood that other electrical apparatus that is operated and submerged within a cooling fluid is within the scope of this invention.

The transformer structure 11 (FIG. 2) is comprised of a pair of opposite end walls 23, 25, a bottom wall 27, a top wall 29 (FIG. 1), opposite side walls 31, 33 on each of which a plurality of the heat exchanger panels 21 are mounted. In addition, four similar support braces or angle members 35 are located at the corners where the several respective walls converge. The several walls 23, 33 and members 35 are secured together in a suitable manner, such as by welds along adjacent edges to form the rectangular structure shown in FIG. 1. It is understood, however, that although a rectangular structure is disclosed, any other structure, such as octagonal or cylindrical may be used. Also, although two heat exchanger banks 17, 19 are provided on opposite sides, any other number of banks, such as one bank 17 or three or more banks of similar structure, may be provided on corresponding external walls of the tank.

To facilitate assembly and rigidity of structure the end walls 23, 25 include similar flanges 37, 39. The flanges 37 at the lower ends of the end walls 23, 25 cooperate with the angle members 35 to reinforce each other. Bars 40 reinforce the bottom wall and contribute to the rigidity of the planar end walls 23, 25. The flanges 37 at the upper end of the end walls likewise cooperate with the upper pair of angle members 35 for reinforcing the members with the walls and for providing a base for welding of the top wall 29 in place. The inturned flanges 39 on both end walls provide a base on which the side walls 31, 33 are welded. The end wall 23 comprises an opening 41 for the mounting of low voltage bushings (not shown). Likewise, the end wall 25 comprises a number of openings 43 in which high voltage bushings may be mounted. The openings 41, 43 are disposed merely to indicate that such bushings may be mounted in the end walls. However, the bushings may be mounted in openings in the top wall 29.

In accordance with this invention each heat exchanger panel 21 is comprised of a pair of oppositely disposed sides 45, 47 (FIGS. 3,5) which are sheet-like members formed from sheet stock by rolling in one direction to form oppositely disposed corrugations 49 and 51. Corresponding pairs of corrugations 49, 51 are aligned and oppositely disposed (FIG. 5) to provide longitudinally extending fluid flow conduits 53 between which concave portions 55, 57 are disposed in aligned, surface-to-surface contact for fluid-tight separation between adjacent conduits 53. As shown, the concave portions 55 and 57 are in surface-to-surface contact, but may be slightly spaced. For reinforcement the panel side 45 comprises a plurality of longitudinally extending, transversely spaced longitudinal portions, such as portions 59, 61 (FIG. 5), which are aligned with corresponding portions 63, 65 in the panel side 47. The corresponding portions 59, 63 are secured together, such as by spot welding at 67 (FIG. 3), whereby the facing panel sides 45, 47 are retained intact to serve as heat exchangers for cooling fluid flowing through the conduits 53.

Figure 7:
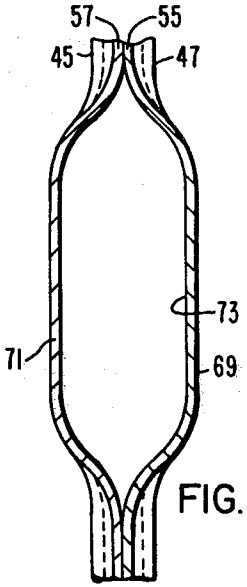
FIG. 7 is an enlarged vertical sectional view taken on the line VII—VII of FIG. 3.

Moreover, the panel sides 45, 47 comprise convex portions 69, 71, respectively, which extend transversely of the panels and which are aligned (FIGS. 5, 7) to provide a fluid-conducting header 73. A similar fluid conducting header 75 is provided at the lower end of the panel (FIGS. 3, 6) by providing the panel sides 69, 71 with convex portions 77, 79, respectively. At the upper end of the panel 21 a similar fluid conducting header 81 is provided by forming convex portions 83, 85 (FIG. 3) at the upper end of the panels 21. All of the fluid conducting headers 73, 75, 81 are formed by the alignment of the corresponding convex portions which in turn are formed by stamping the previously corrugated sides to provide the convex portions preferably perpendicular to the conduits 53. When assembled the upper and lower transverse edges as well as the longitudinal edge are welded at 87, 89, 91 in surface-to-surface fluid-tight contact thereby providing a fluid-tight panel which serves as a heat exchanger for the cooling fluid from the interior of the tank 13 whereby fluid entering one of the headers flows vertically through the conduits 53 to another header from where it is returned to the tank chamber.

Figure 3:
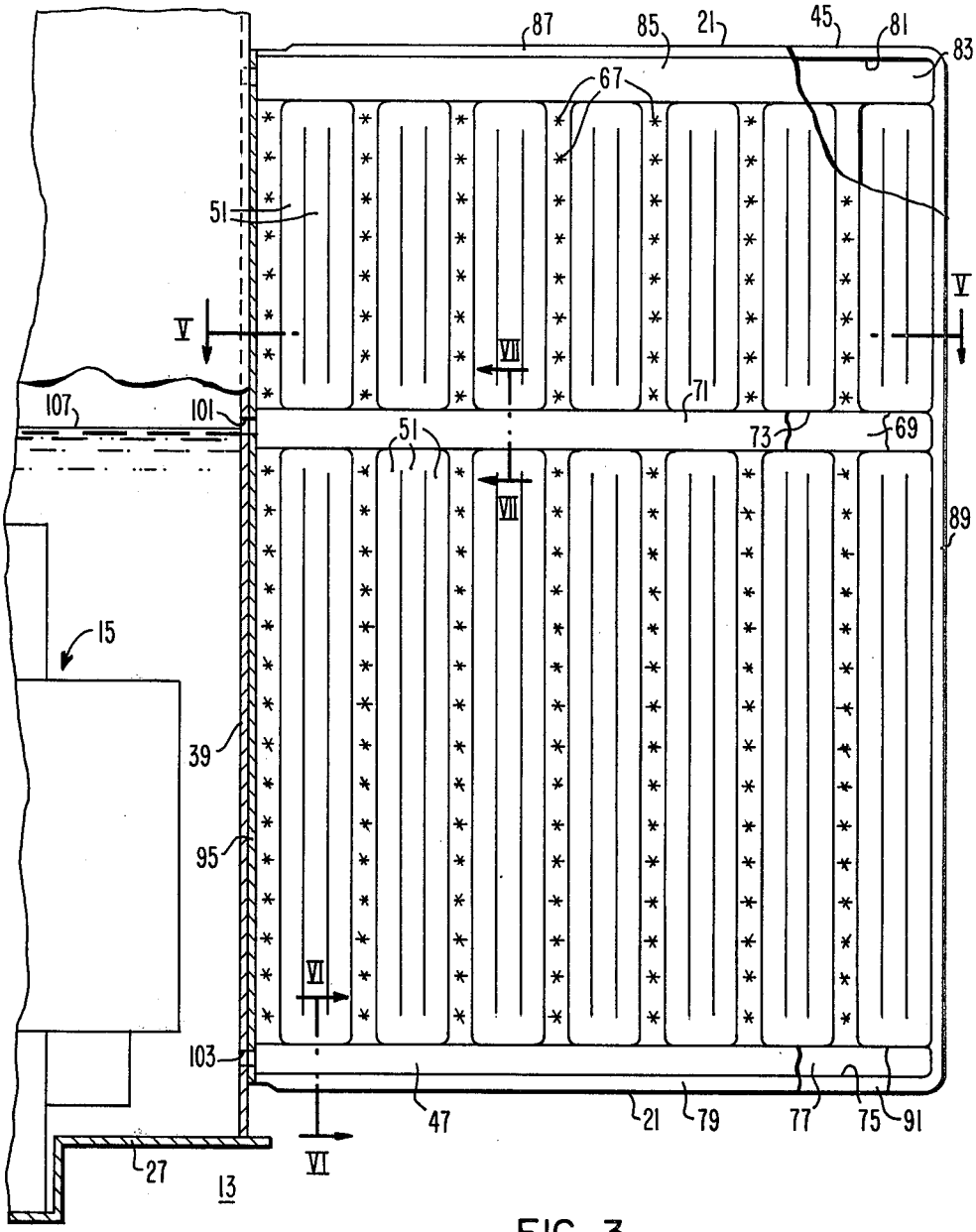
FIG. 3 is an enlarged elevational view, taken on the line III—III of FIG. 1 of a cooling panel, with an associated transformer tank portion shown partially in section.
Figure 5:
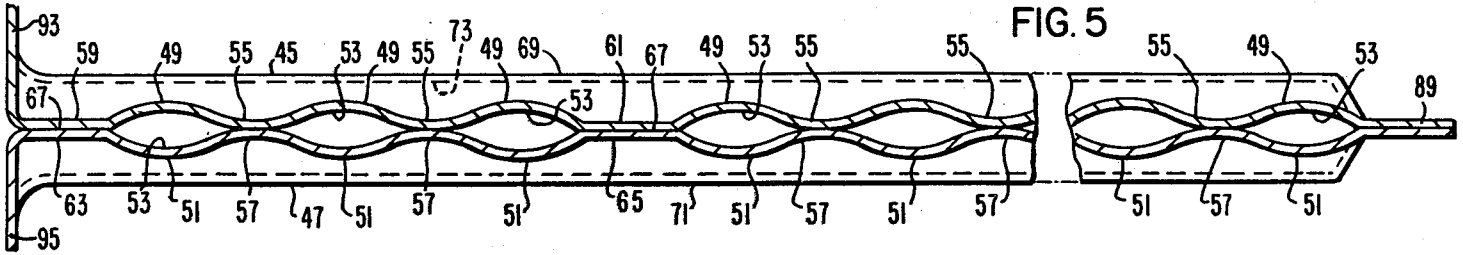
FIG. 5 is an enlarged, fragmentary, horizontal sectional view taken on the line V—V of FIG. 3.
Figure 6:
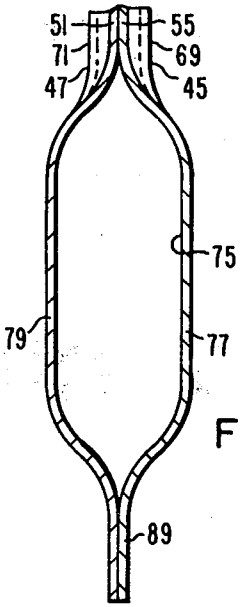
FIG. 6 is an enlarged vertical sectional view taken on the line VI—VI of FIG. 3.

In accordance with the invention each panel side 45 and 47 is provided with an out-turned flanges 93, 95, respectively (FIGS. 3, 4, 5). A plurality of panels 21 are assembled by aligning the flanges 93, 95 of adjacent panels in edge-to-edge abutment (FIG. 4), where they are secured together in a fluid-tight manner, such as by similar welds 97 to provide a planar side (FIG. 2) for each side of the tank 13. Alternatively, the flanges 93, 95 may be overlapped for welding rather than butted as shown. Accordingly, a plurality of assembled panels 21, such as by welds 97, comprise a side of the tank 13. In the embodiment disclosed in the drawings, two opposite sides of the tank are provided with similar side walls. It is understood that one or more such walls may be provided, for example, where the cross section of the tank is greater than rectangular such as hexagonal or octagonal. Indeed, a cylindrical tank may have one or more arcuate sides thereof covered by sections of assembled panels 21 as described above.

As shown more particularly in FIG. 2, each panel 21 comprising panel sides 45, 47, comprises openings 99, 101, and 103. Each opening 99 (FIG. 3) communicates with a corresponding fluid conducting header 81. Likewise, each opening 101 communicates with a corresponding fluid conducting header 73, and each opening 103 communicates with a corresponding lower fluid conducting header 75.

As shown in FIG. 1, the assembly of each heat exchanger panel 21 on opposite sides of the tank 13 is secured in place in a suitable fluid-tight manner, such as peripheral welds, along the upper and lower ends of the assembled flanges 93, 95 as well as along opposite vertical edges, such as a weld 105. The vertical welds, such as the weld 105, are secured to the vertical flanges 39 (FIG. 2) and the horizontal welds across the top and bottom of the panels 21 are secured to the flanges of the upper member 35 and the member 40. Accordingly, a fluid-tight joint is formed by the banks 17, 19 of panels 21 on opposite sides of the tank 13.

The bottom wall 27 as well as the top wall 29 are secured in place by fluid-tight joints between ends and edges of the top and bottom walls with adjacent other walls and members of the tank 13. The joints therebetween preferably comprise welds (not shown).

As shown in FIG. 3, electrical apparatus such as the transformer unit 15 is contained in the tank 13 where it is supported on the bottom wall 27. The unit 15 is submerged within a coolant fluid having a level 107 which is at least as high as the openings 101 which communicate with the fluid conducting headers 73. As the temperature of the transformer unit 13 increases during operation, the heated coolant fluid rises to the level 107 and moves through the openings 101, the headers 73, downwardly through the conduits 53 to the lower header 75 and then through the openings 103 to the lower portion of the tank 13, thereby completing a cooling cycle in accordance with this invention. The upper portions of the heat exchanging panels 21 above the fluid conducting headers 73, which comprise the upper ends of the conduits 53 and the fluid conducting header 81, provide for air circulation between the upper portion of the tank 13 and the heat exchanging panels 21. An additional function of the upper portions of the panels is to absorb expansion of the volume of the fluid where excess heating occurs. The upper portions of the several panels 21 above the fluid conducting headers 73 extend to the upper end of the side walls and thereby resist pressures in the tank which may occur from time to time.

Where for the given tank a larger transformer unit 13 may be provided, the upper end of which may extend above the level of the intermediate fluid conducting header 73, such header may be deleted and the fluid level 107 raised to the upper fluid conducting header 81. In such case, the heated coolant fluid passes through the openings 99, the header 81 and then downwardly through the several conduits 53 to the header 77 from where it reenters the tank 13 through the openings 103.

In conclusion, the tank and heat exchanger assembly of this invention provides for a heat exchanger unit having corrugated walls to reduce the volume of the coolant fluid and to provide for more efficient heat exchange between the fluid and the ambient air. In addition, by mounting the several heat exchanging panels perpendicular to the walls of the tank, the panels reinforce the walls in combination with the several welded joints and thereby enable the use of stock sheet having a smaller gauge, such as 0.040 to 0.060 inch instead of a higher thickness such as 0.25 to 0.375 inch.

What is claimed is:

1. A tank for electrical apparatus submerged in a cooling fluid for transferring heat from said apparatus to walls of the tank for dissipation therefrom, comprising wall means forming a fluid-containing casing, at least a portion of the wall means having inlet and outlet means for said fluid, a cooling panel extending outwardly from said wall means for dissipating heat to an ambient atmosphere, the cooling panel comprising a pair of oppositely disposed sides having facing peripheral edge portions and end portions that are secured together in a fluid-tight seal, the sides being sheet-like members formed to include aligned corrugated surfaces forming spaced fluid-conducting headers and fluid conduits, one of the sides of the oppositely disposed sides having a first outturned flange along the panel edge opposite the peripheral edge portion, the other of said sides having a second outturned flange extending in a direction opposite the first flange, the first and second flanges solely comprising said wall means of the tank with the cooling panel being the sole reinforcement of the wall means against internal pressures within the tank, one header extending from the outlet means and the other header extending from the inlet means, the fluid conduits extending between the spaced headers, whereby volume of cooling fluid space is minimized, and each cooling panel having a portion extending above the outlet means so as to accommodate any expansion of cooling fluid where excess heating occurs.

2. The tank of claim 1 in which the sides forming the aligned corrugated surfaces comprise oppositely convex surfaces extending longitudinally between and communicating with the headers that extend transversely of the conduits to provide a circulating flow passage for the cooling fluid between the tank and the panel.

3. The tank of claim 2 in which the sides comprise surface-to-surface contacting portions between the fluid conduits.

4. The tank of claim 3 in which the sides are comprised of formed sheet metal.

5. The tank of claim 4 in which each side comprises an out-turned flange along the edges adjacent the tank thereby forming at least a portion of the tank wall.

6. The tank of claim 5 in which the panels extend between the top and bottom ends of the tank.

7. The tank of claim 5 in which there are a plurality of panels with the out-turned flanges of adjacent panels being secured together in a fluid-tight manner.

8. The tank of claim 7 in which the tank has opposite side walls, opposite end walls, and top and bottom end walls, in which the flanges on at least one panel comprise one side wall.

9. The tank of claim 8 in which the flanges of a plurality of panels comprise at least one wall of the tank.

10. The tank of claim 9 in which the edges of the flanges of adjacent panels are welded together to provide an integral tank wall.

11. The tank of claim 10 in which the tank has a rectangular cross section of which at least one wall comprises a plurality of panels.

* * * * *